US007050890B2

(12) United States Patent
Tolmei

(10) Patent No.: US 7,050,890 B2
(45) Date of Patent: May 23, 2006

(54) SAFETY SYSTEM TO DETECT AND ANNUNCIATE THE LOSS OF OCCUPANCY DETECTION IN TRANSIT SYSTEMS

(75) Inventor: Ron Tolmei, 5258 Grasswood Ct., Concord, CA (US) 94521

(73) Assignee: Ron Tolmei, Walnut Creek, CA (US)

( * ) Notice: Subject to any disclaimer, the term of this patent is extended or adjusted under 35 U.S.C. 154(b) by 124 days.

(21) Appl. No.: 10/796,380

(22) Filed: Mar. 9, 2004

(65) Prior Publication Data

US 2005/0216143 A1 Sep. 29, 2005

(51) Int. Cl.
*G06F 17/00* (2006.01)
*B61L 23/00* (2006.01)

(52) U.S. Cl. ..... 701/20; 701/19; 340/933; 246/28 R

(58) Field of Classification Search ..... 701/20, 701/19, 79, 301; 340/905, 933
See application file for complete search history.

(56) References Cited

U.S. PATENT DOCUMENTS 6,218,961 B1 * 4/2001 Gross et al. ..... 340/903
6,402,094 B1 * 6/2002 Beer ..... 246/122 R
6,480,766 B1 * 11/2002 Hawthorne et al. ..... 701/19
6,490,523 B1 * 12/2002 Doner ..... 701/213
6,813,562 B1 * 11/2004 Altan et al. ..... 701/301
2005/0107954 A1 * 5/2005 Nahla ..... 701/301

* cited by examiner

*Primary Examiner*—Thomas G. Black
*Assistant Examiner*—Marie A. Weiskopf

(57) ABSTRACT

A system used to detect and annunciate a loss of occupancy detection in transit systems normally operating under automatic train control operation is disclosed. Upon manual or automatic engagement of operation the system, in collaboration with the existing automatic train control electronics, detects and annunciates the loss of occupancy detection by querying the train's trailing speed control blocks for any valid nonzero speed command that would allow other trains to enter that already occupied block—causing a collision! Additionally, in the present invention the system's self checking error and failure detection operation is automatically checked during normal running mode of operation and as such each individual component of the entire automatic train operation is checked for failure in its entirety and the system is void of undetected latent failures owing to its design, stability, and simplicity of operation.

7 Claims, 2 Drawing Sheets

SAFETY SYSTEM TO DETECT AND ANNUNCIATE THE LOSS OF OCCUPANCY DETECTION IN TRANSIT SYSTEMS

CROSS-REFERENCE TO RELATED APPLICATIONS

References Cited

U.S. Patent Documents

| | | | |
|---|---|---|---|
| 4387870 | June 1983 | Matty, et al. | 246/122R |
| 4026506 | May 1977 | Bourke, et al. | 246/34R |
| 3991958 | November 1976 | Sibley et al. | 246/34R. |
| 5026009 | June 1991 | Milnes | 246/122R. |

BACKGROUND OF THE INVENTION

1. Field of the Invention

The present invention relates to a safety system to detect and annunciate when a transit vehicle, such as a train operating on rails and controlled by an automatic train control system, experiences a loss of occupancy detection. When a loss of occupancy detection occurs the train control system believes there are no trains in that section, called block, of track and would allow an oncoming train to enter the already occupied block causing an unsafe condition or worse—a collision.

2. Discussion of Background

With the advent of high-speed close headway rapid transit systems operating on rails such as the Bay Area's Rapid Transit system, BART, and Municipal Railway, MUNI, in San Francisco Calif. it is imperative that the systems controlling these trains know exactly where the trains are at any point in time.

It has been, and still is, an ongoing problem detecting with absolute certainty and reliability where a train is on any section of track without implementing very sophisticated, and often financially restrictive, presence detection equipment coupled with redundant backup systems that unfortunately impact passenger service. This is because of an operating conflict between safety and a transit system's desire to move the maximum number of passengers from point A to point B in the shortest period of time with a high degree of operating reliability. This is exhibited in the design of roads and highways that use signs and lights to display the legal speed limits at which it is deemed safe to travel and still reach your destination in a timely manner. Roadway system designers know that you can move twice the number of people in a car at 120 miles per hour as you can at 60 miles per hour—but not without increasing the risk of an accident to a level of certainty deemed unacceptable for passenger safety.

The vast majority of rapid transit systems today, such as BART or MUNI, have a minimum of two cars in a train, sometimes called consist, with cars at the beginning and end of the train having identical Automatic Train Operation (ATO) electronics. This is because rapid transit systems use parallel fixed track structures with each track having only one normal direction of travel. As such, train direction is reversed by the train operator relocating to the opposite end of the train and central control physically switching, via track switches, the train onto the parallel track to run in the reverse direction.

The majority of existing rapid transit systems control the speed and location of trains by using duel mode track signaling and occupancy detecting systems built into the running rail tracks and controlled by wayside Automatic Train Control (ATC) systems. These systems transmit predetermined speed commands to the trains, as a function of track occupancy, grade, and position, to the front of the train in essence pulling it along. Train detection is accomplished by removing these speed commands, using the train's wheels to short out the signals, normally received by track receivers that are physically located behind the train. These receivers in turn communicate with trailing track transmitters that transmit speed commands to following trains. It is important to note that although Automatic Train Operation (ATO) systems are present in both the leading and trailing cars of a train, and the trailing car's ATO system deactivated, the trailing block immediately behind the train should never be transmitting a non-zero speed command—this is paramount to this invention. The inherent safety-operability paradox in this type of control system is the minimum amount of signal the train needs to proceed versus the amount of signal the trailing receiver sees after shunting by the trains wheels. If the signal received by the leading car's on-board ATO is too low the train won't proceed and if the signal received by the trailing block's wayside receiver is to high the ATC system assumes no train is in the block.

The most common problems associated with occupancy detection systems that use trains wheels to short out the speed command signal are poor electrical contact caused by: rusty rails, contact between the train wheel-rail interface, and short signaling block lengths—all of which are dependent on running rail resistance. Of additional concern is the reduction, or sometimes total loss, of speed command signals due to leakage of track signals, often caused by rain, into the earth. This results in what is called false occupancy, or FO's, and will stop a train's movement until cleared.

As these detection problems became known throughout the transit industry attempts were made to back-up the primary detection system by alternate means. One such attempt, exemplified by BART, was to install a separate computer system that does not allow a block that was previously occupied to be cleared until the next sequential block in a train's path is detected. This system is still in use at BART today and is called the Sequential Occupancy Release System, or SORS.

Although this system does increase safety its penalty on system throughput is severe especially whenever a false occupancy occurs. This is because whenever a false occupancy occurs there is no real train on the track and therefore the block cannot be released by occupying the next sequential block because there is no train to enter the block. The problem can only be resolved by human intervention and therefore is susceptible to error as, after repetitive false occupancies, operators become conditioned by the event and manually clear the block—when in fact there is a train is in the block.

In order to resolve these concerns in a timely and cost-effective manner a solution must be found that: is compatible with the existing system, does not degrade passenger service, increases passenger throughput and above all passenger safety—all of which this present invention, as follows, uniquely satisfies.

BRIEF SUMMARY OF THE INVENTION

Accordingly with the major factors associated with the loss of occupancy detection, already briefly recited, the present invention provides a back-up safety system for detecting and annunciating the loss of occupancy detection in rapid transit systems operating under automatic train controls. The system is comprised of the existing Automatic Train Operation equipment on board the train, a controller, bi-directional transceivers to communicate the loss of occupancy detection and an auxiliary, but not mandatory, global positioning system to uniquely identify the physical location of the loss.

It is normal operating practice in transit systems operating on rail to provide the lead car in the direction of travel, and containing the on-board train ATO equipment, a speed command to proceed to the next block based upon information received from blocks preceding the train if no train is in the preceding block, i.e. immediately in front of the train. Conversely, the block being occupied by the last car of the train, under control of the wayside ATC, would command the following train to stop—there should always be a zero speed command at least one block behind any train. It is this zero speed command that is normally undetected by the train's trailing car that can be used to detect a loss of occupancy detection. If this command is ever anything other than a zero speed command the wayside ATC and or associated equipment has not detected the train. By examining this command one can tell if any anomaly has occurred in the entire ATC system and therefore is a near foolproof means of detecting a loss of occupancy. The simplest way of detecting this command, on-board the existing train, is to turn on the ATO system located in the trains trailing car, which is normally turned off when going in the reverse direction, while disabling its control of the train's propulsion-braking systems. Now the ATO system will read the trailing blocks command but will not control the train. It is a simple matter to detect any speed command from the trailing block of the train and communicate this to the appropriate recipient, such as the train operator, central control, wayside ATC or other supervisory systems.

Bi-directional communication with wayside can be accomplished using conventional technology such as: radio frequency, infrared, laser, or hardwired transceivers or even the means used to supply traction power to the train. If desired the exact location of the failed block can be sent using this media via input from Global Positing Systems (GPS) technology already developed for this purpose.

Other features, and their advantages, of this system will be apparent to those skilled in the art of train control from a careful reading of the Detailed Description of Preferred Embodiments accompanied by the following drawings.

DETAILED DESCRIPTION OF THE INVENTION

The present invention is a safety system to detect and annunciate whenever a valid nonzero speed command is issued to a train following in the same direction of travel as a preceding train and either in the same block or trailing block as the preceding train. The safety system uses the existing Automatic Train Operation electronics located in the last car, but not in a control mode, to receive, decode, and process the trailing block's speed command and upon reception of a non-zero command annunciate and communicate that information to the appropriate systems which is the embodiment of the present invention.

Figure 1:
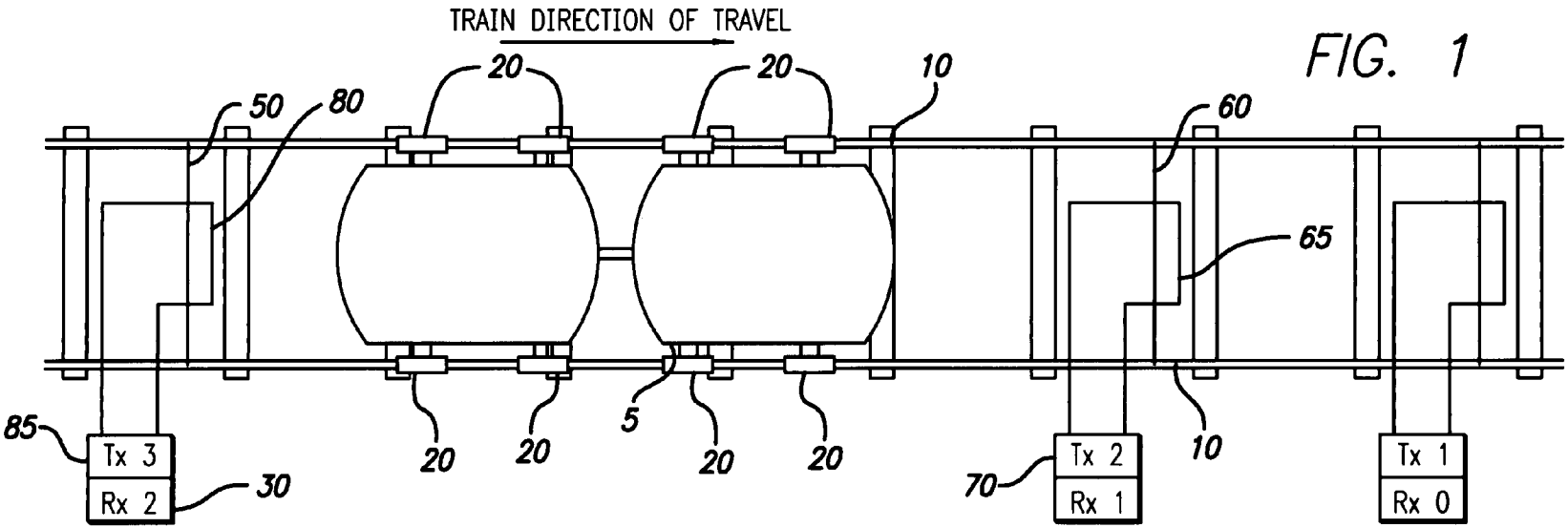
FIG. 1 is a block diagram of a conventional train detection system showing occupancy detection using coordinated transmitter-receiver pairs to detect speed commands directly behind the last car in the train according to the preferred embodiment of the present invention.

FIG. 1 is a block diagram of a conventional train detection system showing the speed command being transmitted to train 5, by antenna 65, of transmitter TX2, reference 70, and not being received by antenna 80, of RX2, reference 30, when a train is between shunt 50 and shunt 60. This loss, or reduction, of signal at antenna 80 of RX2, reference 30, is being caused by the shorting of rails 10, by wheels 20 of train 5, from antenna 80 of receiver RX2, reference 30, indicating an occupancy between shunt 60 and shunt 50. When a train is not located between shunt 60 and shunt 50 there is no shunting of the signal between 60 shunt 50 and therefore there is no loss, or reduction, of the speed command received by antenna 80, of RX2, reference 30, causing the automatic train control system's electronics, located elsewhere, to indicate there is no occupancy in the block between shunt 50, and shunt 60.

Additionally shown in FIG. 1 is the speed command, whose value is dependent on the signal being received at RX2, reference 30, by antenna 80, being transmitted by antenna 80, of transmitter TX3, reference 85, to the following train.

Figure 2:
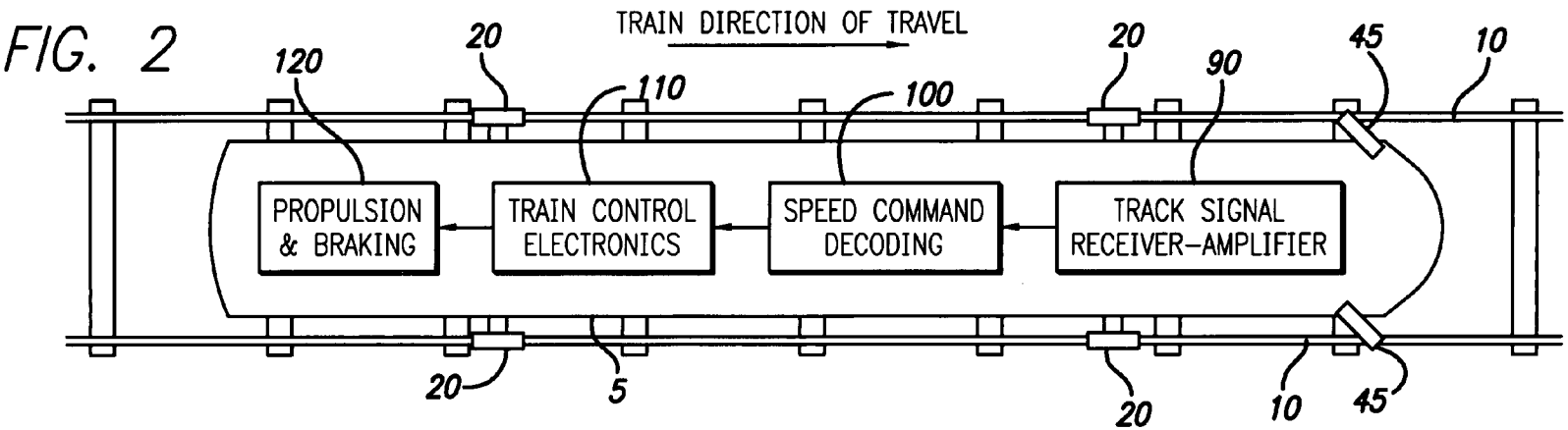
FIG. 2 shows a block diagram of conventional ATO electronics located on board the leading car, used in the direction of travel, to acquire and process train speed commands.

Shown in FIG. 2 is the normal ATO configuration of a leading car 5, in the direction of travel, with speed commands being transmitted from running rails 10 and received from car mounted antennas 45. The speed command signals are then received by track signal amplifier 90 processed and then sent to speed command and decoding 100 that processes and decodes the speed commands and sends them to train control electronics 110 where they are processed and sent to the trains propulsion and braking system 120. In the direction of travel the lead car's ATO system is in control of the entire train while the ATO in trailing car of the train is turned off and has no control or function. When the train reaches the end of the line and it is desired to reverse the direction of travel the train operator switches off the ATO of the car, walks to the opposite end of the train and switches on its ATO system. The trailing car now becomes the leading car, in the reverse direction of travel, and its ATO is now in total control of the train while the now trailing car becomes inactive having no control or function.

Figure 3:
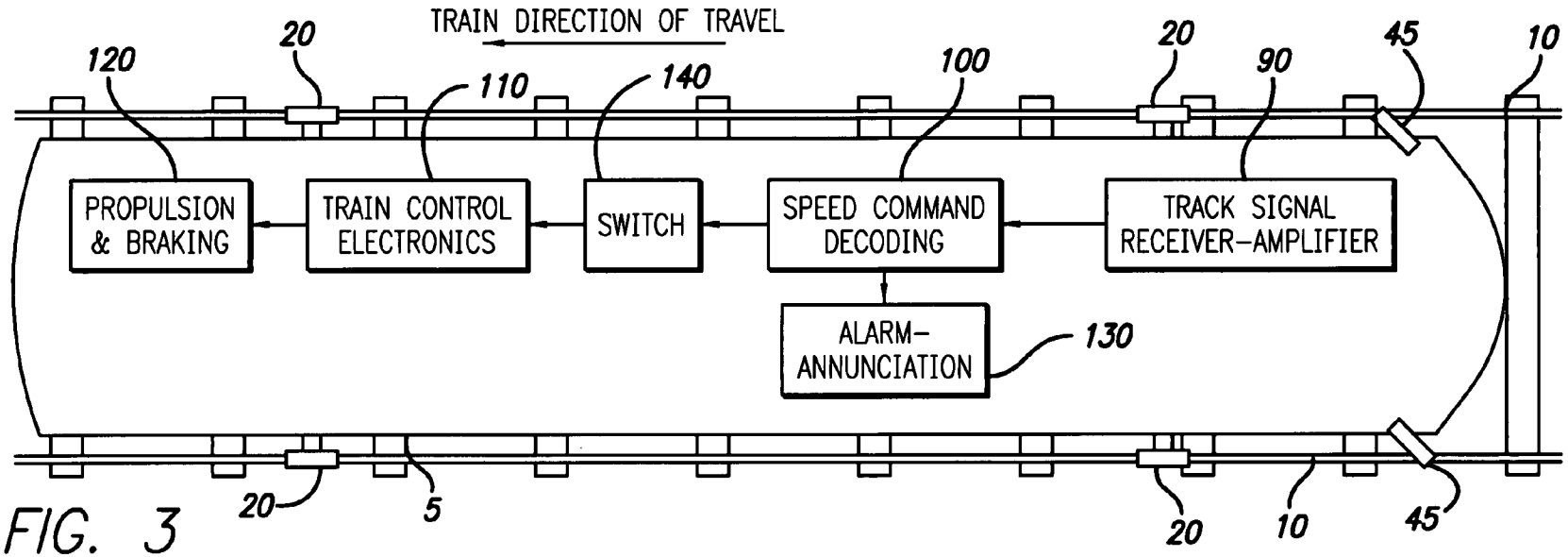
FIG. 3 shows a block diagram of a conventional ATO system modified with the installation of an alarm-annunciation system activated in the trailing car of a train.

In order to receive the track signals behind the trailing car, that is the embodiment of this invention, we must turn on the trailing cars ATO while disabling its control functions as illustrated in FIG. 3 by switch 140 and enabling the alarm-annunciation system 130. Antennas, 45, located on the front of car 5 receive the speed command from running rails 10, and are then amplified and formatted by track signal receiver amplifier 90. This amplified and formatted signal is then sent to speed command decoding circuits 100, and alarm-annunciation electronics 130 that detect, process, and alarm any occurrence of a valid nonzero speed command. Because train control electronics 110, and propulsion-braking systems 120 are receiving speed commands from the leading cars ATO, via switch 140, and not by the speed commands being received by the trailing car's ATO 45, 90, 100 they are unaffected by trailing block anomalies in this mode of operation.

Figure 4:
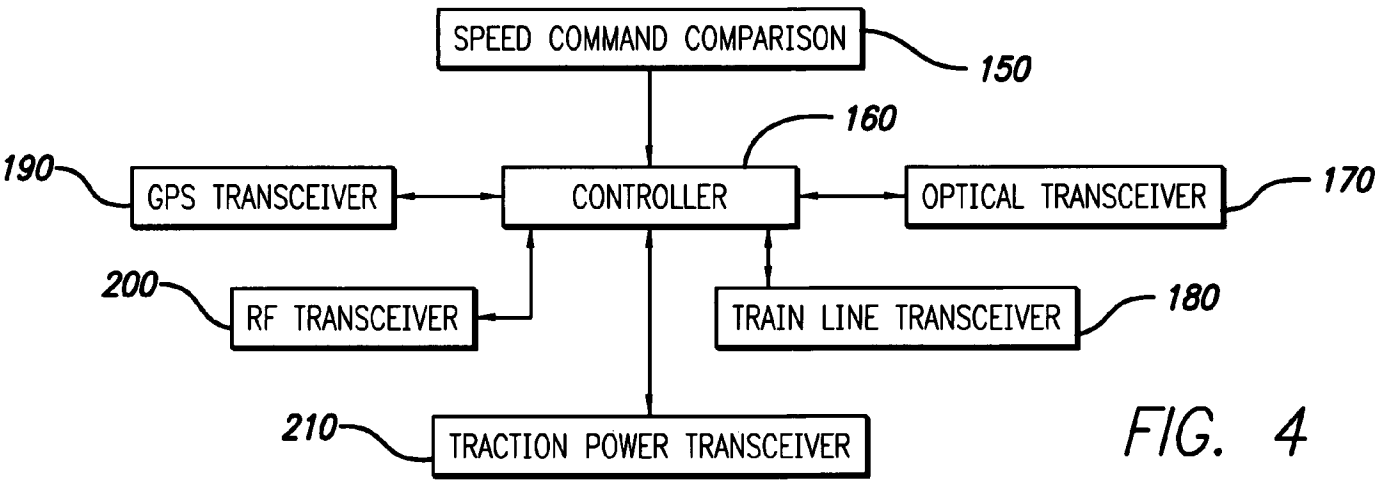
FIG. 4 is a block diagram of the alarm-annunciation system when installed in the trailing car according to the preferred embodiment of the present invention.

FIG. 4 illustrates details of the alarm-annunciation system with reference 150 receiving speed, and possibly control, commands from the train's ATO speed command decoding electronics of FIG. 3 reference 100. Reference 150 compares this speed command with known valid nonzero speed commands and if it determines that the speed command is valid and is greater than zero sends this command to controller 160. Controller 160, which has the additional capability of receiving Global Positioning System (GPS) information via GPS receiver 190 from satellites, selects which communications medium, or mediums, is appropriate for transmission at that particular train location based upon operator intervention, GPS data, or wayside communication from the ATO. Additionally, the controller 150 formats the message for the selected communication medium to be transmitted to the appropriate authority for alarm and corrective action.

Radio Frequency (RF) communications transceiver 200, if selected by the communications controller 160, transmits or receives the appropriate information from or to the receiving authority for alarm and corrective action. Optical transceiver 170, which is comprised of infrared, laser, or other optical spectra optical, transmits or receives the data by way of fiber optics or other line of sight communication means to the receiving or transmitting authority when directed by the controller.

As a multimode mechanism the controller also has the capability to select a local mode of communication to the train operator by using train line transceiver 180 and train lines. Additionally traction power transceiver 210, also under control of controller 160, has the necessary electronics to transmit or receive data from wayside equipment using the train's paddles or catenaries that couple traction power from the train to wayside.

There are, depending upon the complexity and desired capabilities, numerous ways of implementing the alarm-annunciation system and associated components. These include dedicated standalone computers, existing on board ATO or ancillary computer equipment, programmable logic controllers (PLC), electromechanical systems, and numerous other devices available. Therefore, the present invention is not limited to the embodiment shown, but also includes any means for detecting and annunciating whenever a trailing oncoming train receives a command to proceed into either an occupied, or trailing block behind the occupied block of track.

It is readily apparent to those skilled in the art of train control and occupancy detection from reading the foregoing that many substitutions and modifications, including but not limited to using the leading cars ATO with the alarm-annunciation system, may be made to the preferred embodiments described without departing from the spirit and scope of the present invention.

I claim:

1. A system for detecting and annunciating when a loss of occupancy detection in transit systems, such as a train operating on rails and controlled by an automatic train control system, goes undetected with said system comprising:

a first car in a train with an automatic train operation system which detects a speed command of a proceeding block;

an end car in a train with an automatic train operation system which detects the speed command of a trailing block while its control function is disabled;

a speed command comparison device to compare the speed command of the trailing block with known speed commands; and an automatic train control system communicating with said speed command comparison device and a controller device that controls the reception or transmission of speed commands and formatting of a Global Position System receiver's output data, speed commands and decoded data received from said speed command comparison device whose data output is supplied to an optical transceiver, radio frequency transceiver, train line transceiver, or traction power transceiver for the purpose of detecting and annunciating when a train whose presence should be detected and annunciated goes undetected and unannounced.

2. The system as recited in claim 1, further being compatible with but not required for operation, a speed and data decoding device comprised of computer electronics and software algorithms as a means of decoding control data and speed commands received from an on board automatic train control system for the purpose of detecting a valid nonzero speed command and ancillary data.

3. The system as recited in claim 1, wherein said system being compatible with but not required for operation, a controller being comprised of computer electronics and software algorithms as a means of formatting, selecting, and communicating with a Global Positing System's receiver output and; a radio frequency transceiver; optical transceiver; a train line transceiver and a traction power transceiver to communicate the loss of occupancy detection to train and wayside authorities.

4. The system as recited in claim 1, further being compatible with but not required for operation, a system comprised of an optical transceiver itself being comprised of laser, infrared, or other optical spectra transceivers whose purpose is to communicate the loss of occupancy detection to train and wayside authorities.

5. The device as recited in claim 1, wherein said radio frequency transceiver, being compatible with but not required for operation, and comprised of electromagnetic spectra transmitter-receiver equipment necessary to communicate the loss of occupancy detection to train and wayside authorities with a high degree of reliability.

6. The device as recited in claim 1, further being compatible with but not required for operation, a train line transceiver capable of communicating with existing train communications equipment to annunciate the loss of occupancy detection to train authority without interference.

7. The device as recited in claim 1, wherein being compatible with but not required for operation, a traction power transceiver with the capability to communicate over traction power couplings to annunciate the loss of occupancy detection to wayside authorities with a high degree of immunity from electrical noise.

* * * * *